US009999284B1

(12) United States Patent
Tan

(10) Patent No.: US 9,999,284 B1
(45) Date of Patent: Jun. 19, 2018

(54) FOLDING COLLAPSIBLE LUGGAGE

(71) Applicant: Fu-Hsing Tan, Taoyuan Hsien (TW)

(72) Inventor: Fu-Hsing Tan, Taoyuan Hsien (TW)

( * ) Notice: Subject to any disclaimer, the term of this patent is extended or adjusted under 35 U.S.C. 154(b) by 0 days. days.

(21) Appl. No.: 15/663,805

(22) Filed: Jul. 30, 2017

(51) Int. Cl.
*A45C 5/03* (2006.01)
*A45C 7/00* (2006.01)
*A45C 13/26* (2006.01)

(52) U.S. Cl.
CPC ..... *A45C 7/0036* (2013.01); *A45C 5/03* (2013.01); *A45C 13/262* (2013.01); *A45C 2005/035* (2013.01); *A45C 2013/267* (2013.01)

(58) Field of Classification Search
CPC ..... A45C 7/0036; A45C 5/03; A45C 13/262; A45C 2005/035; A45C 2013/267
See application file for complete search history.

(56) References Cited

U.S. PATENT DOCUMENTS 5,277,449 A * 1/1994 Schmidt ..... A45C 13/385 280/47.26
5,713,441 A * 2/1998 Chen ..... A45C 13/262 16/113.1
5,769,194 A * 6/1998 Chang ..... A45C 5/14 16/113.1
5,901,822 A * 5/1999 Tu ..... A45C 5/14 16/113.1
6,047,798 A * 4/2000 Lin ..... A45C 13/262 16/113.1
7,614,628 B2 * 11/2009 O'Connor ..... A45C 5/143 280/37
9,327,745 B2 * 5/2016 Tsai ..... B62B 1/042
2003/0034636 A1 * 2/2003 Ng ..... A45C 5/14 280/652

* cited by examiner

*Primary Examiner* — Tri Mai

(57) ABSTRACT

A folding collapsible luggage includes a folding collapsible luggage body selectively set between a collapsed position and an extended position, two base blocks fixedly mounted at the bottom side of the folding collapsible luggage body, a retractable handle assembly including two outer tubes fastened to the folding collapsible luggage body and respectively pivotally connected to the base blocks, and two spring-loaded pushers respectively mounted in the base blocks and abutted against the respective bottom ends of the outer tubes for facilitating biasing of the folding collapsible luggage body between the collapsed position and the extended position and stopping the folding collapsible luggage body in the collapsed or extended position positively.

6 Claims, 11 Drawing Sheets

FOLDING COLLAPSIBLE LUGGAGE

BACKGROUND OF THE INVENTION

1. Field of the Invention

The present invention relates to luggage technology and more particularly, to a folding collapsible luggage, which is equipped with spring-loaded pushers to facilitate biasing of the folding collapsible luggage body between the collapsed position and the extended position and to stop the folding collapsible luggage body in the collapsed or extended position positively.

2. Description of the Related Art

When travelling, people usually will use a luggage to carry personal items. However, when a luggage is not in use, it occupies much storage space. In order to reduce storage space, different designs of folding collapsible luggage are created. However, conventional folding collapsible luggage designs are still not satisfactory in function and have drawbacks as follows:

1. When a folding collapsible luggage is collapsed, the user needs to tie up the folding collapsible luggage in the collapsed condition with a rope or belt so as to prohibit the collapsed folding collapsible luggage from extending out accidentally during delivery. It is inconvenient to tie up the collapsed folding collapsible luggage.

2. When a folding collapsible luggage is extended out, it cannot be automatically positioned in the extended position, and thus, a supplementary supporting structure must be provided inside the luggage body to support the luggage body positively in the extended position. The use of the supplementary supporting structure also brings inconvenience to the user.

SUMMARY OF THE INVENTION

The present invention has been accomplished under the circumstances in view. It is therefore the main object of the present invention to provide a folding collapsible luggage, which is equipped with spring-loaded pushers to facilitate biasing of the folding collapsible luggage body between the collapsed position and the extended position and to stop the folding collapsible luggage body in the collapsed or extended position positively.

To achieve this and other objects of the present invention, a folding collapsible luggage comprises a folding collapsible luggage body, at least one base block, a retractable handle assembly and at least one pusher. The folding collapsible luggage body is selectively set between a collapsed position and an extended position. The at least one base block is fixedly mounted at a bottom side of the folding collapsible luggage body. The retractable handle assembly comprises at least one outer tube fastened to a back side of the folding collapsible luggage body. Each outer tube has a bottom end thereof pivotally connected to one respective base block, defining on the bottom end thereof a first abutment surface and a second abutment surface. The at least one pusher is mounted in the at least one base block, each comprising a planar pushing block disposed at a bottom side relative to one respective outer tube of the retractable handle assembly and a spring member stopped between the pushing block and one respective base block to force the pushing block into abutment against the bottom end of the respective outer tube. When biasing the folding collapsible luggage body from the extended position to the collapsed position, the at least one outer tube is biased toward the at least one base block, causing the pushing block of each pusher to be forced by the respective spring member into abutment against the second abutment surface of the respective outer tube. On the contrary, when biasing the folding collapsible luggage body from the collapsed position to the extended position, the at least one outer tube is biased in direction away from the at least one base block, causing the pushing block of each pusher to be forced by the respective spring member into abutment against the first abutment surface of the respective outer tube.

DETAILED DESCRIPTION OF THE PREFERRED EMBODIMENT

Figure 1:
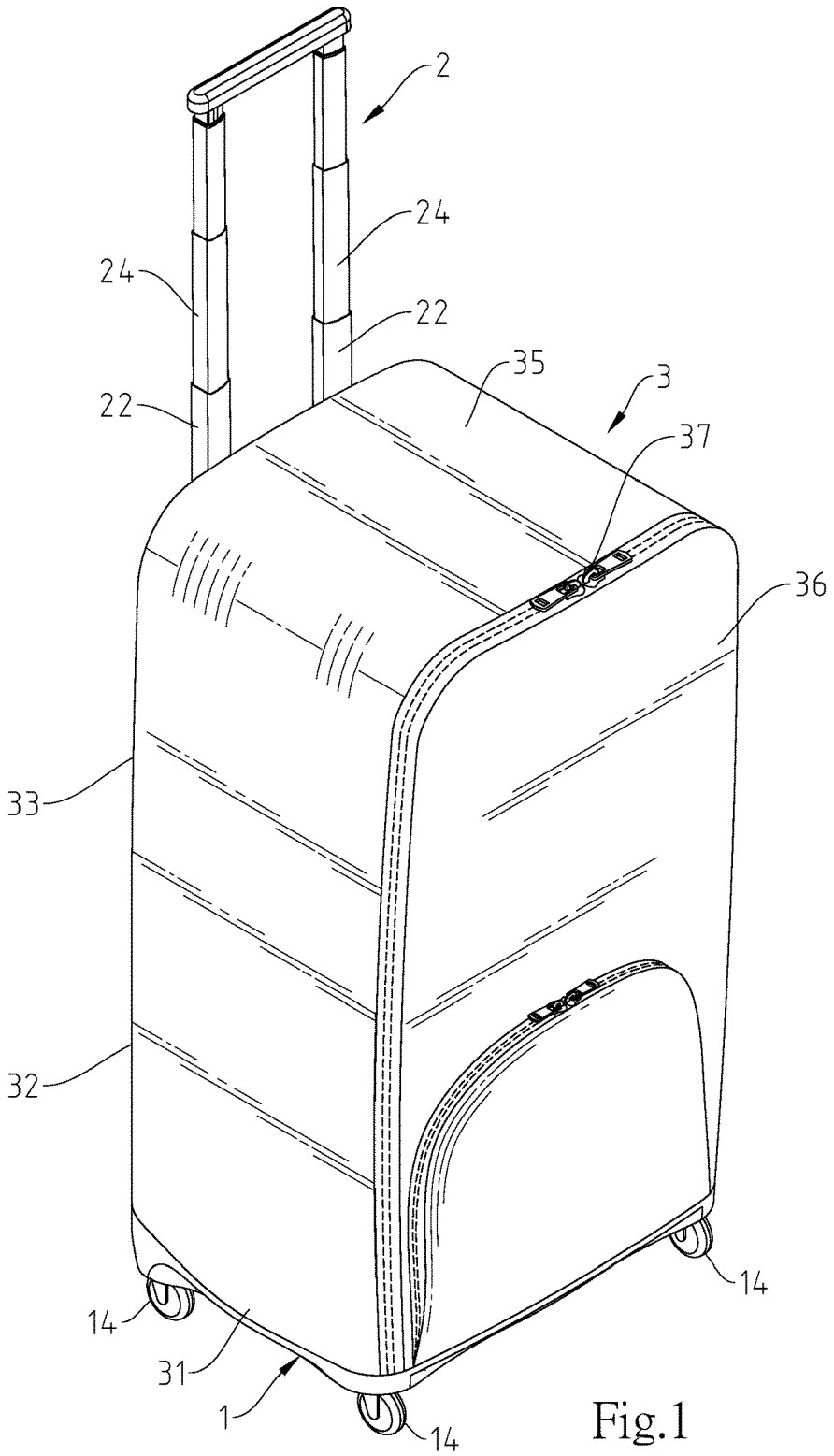
FIG. 1 is an oblique front elevational view of a folding collapsible luggage in accordance with the present invention.
Figure 2:
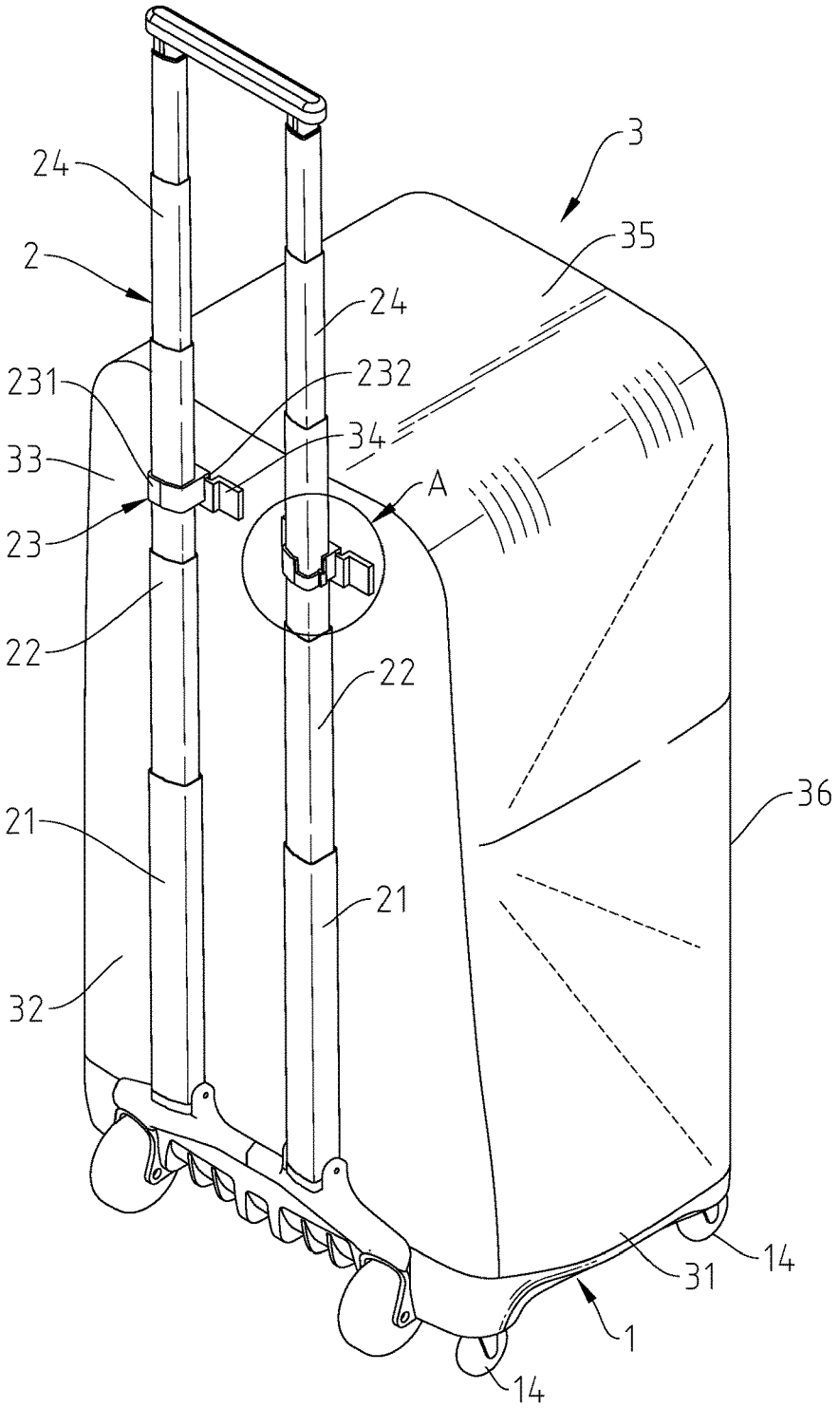
FIG. 2 is an oblique rear elevational view of the folding collapsible luggage in accordance with the present invention.
Figure 3:
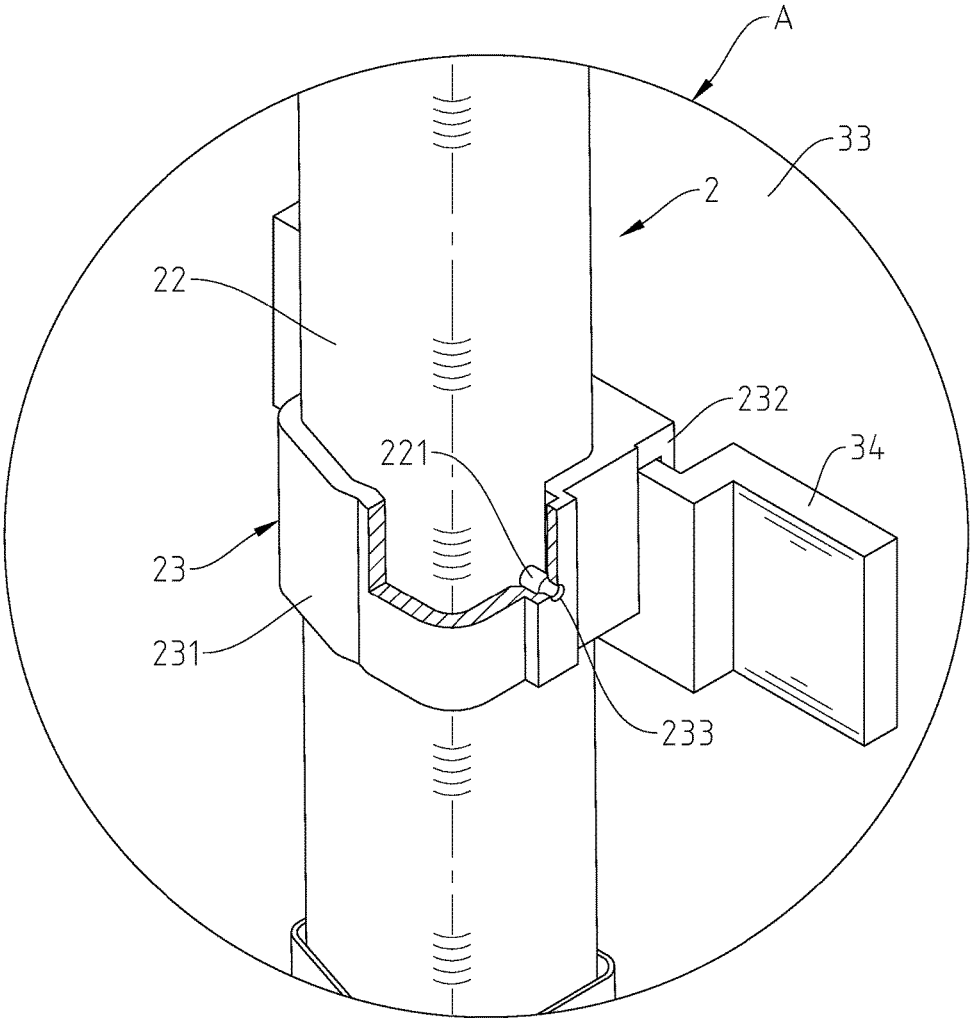
FIG. 3 is an enlarged view of Part A of FIG. 2.
Figure 4:
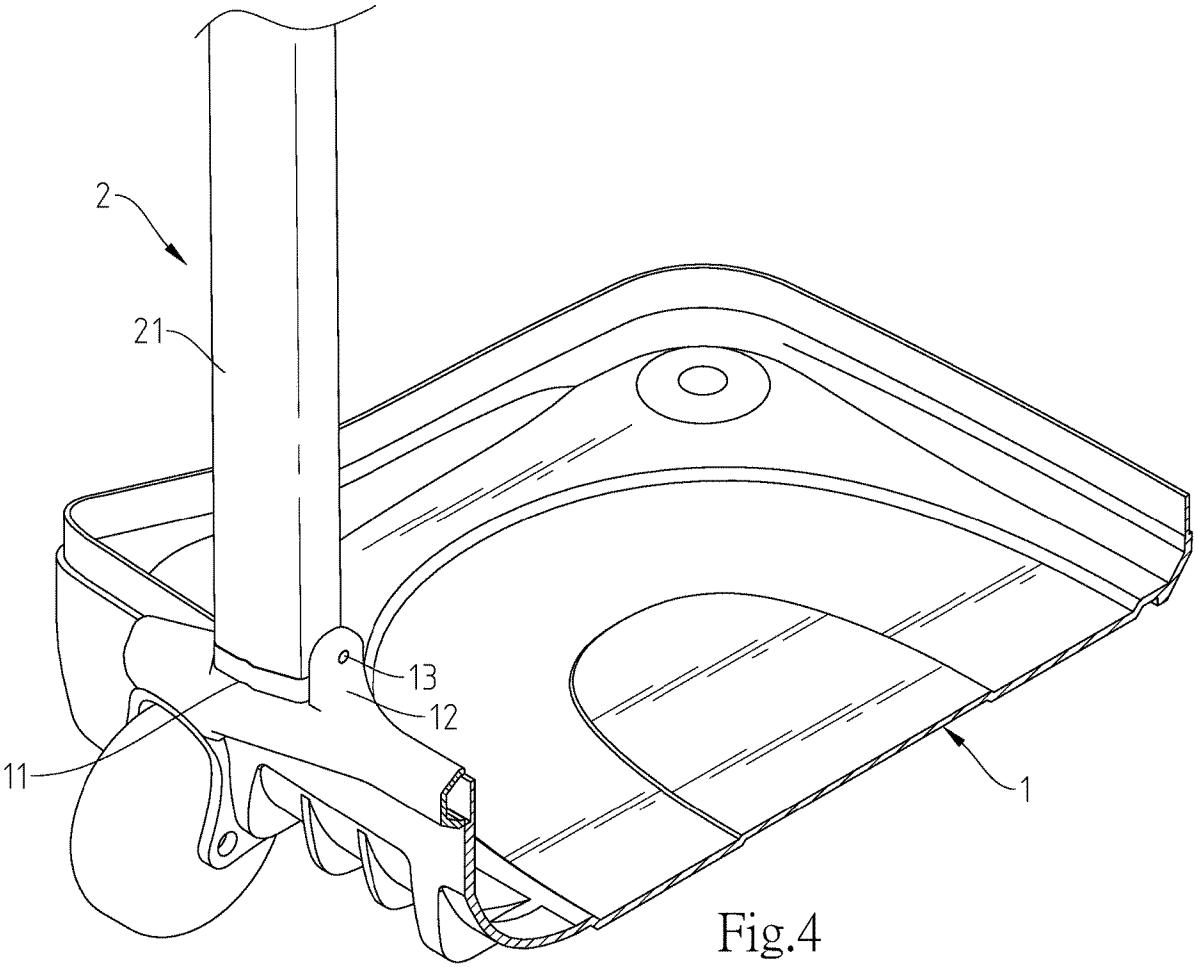
FIG. 4 is a sectional elevational view of a part of the present invention, illustrating the relationship between one base block and the respective outer tube of the retractable handle assembly.
Figure 5:
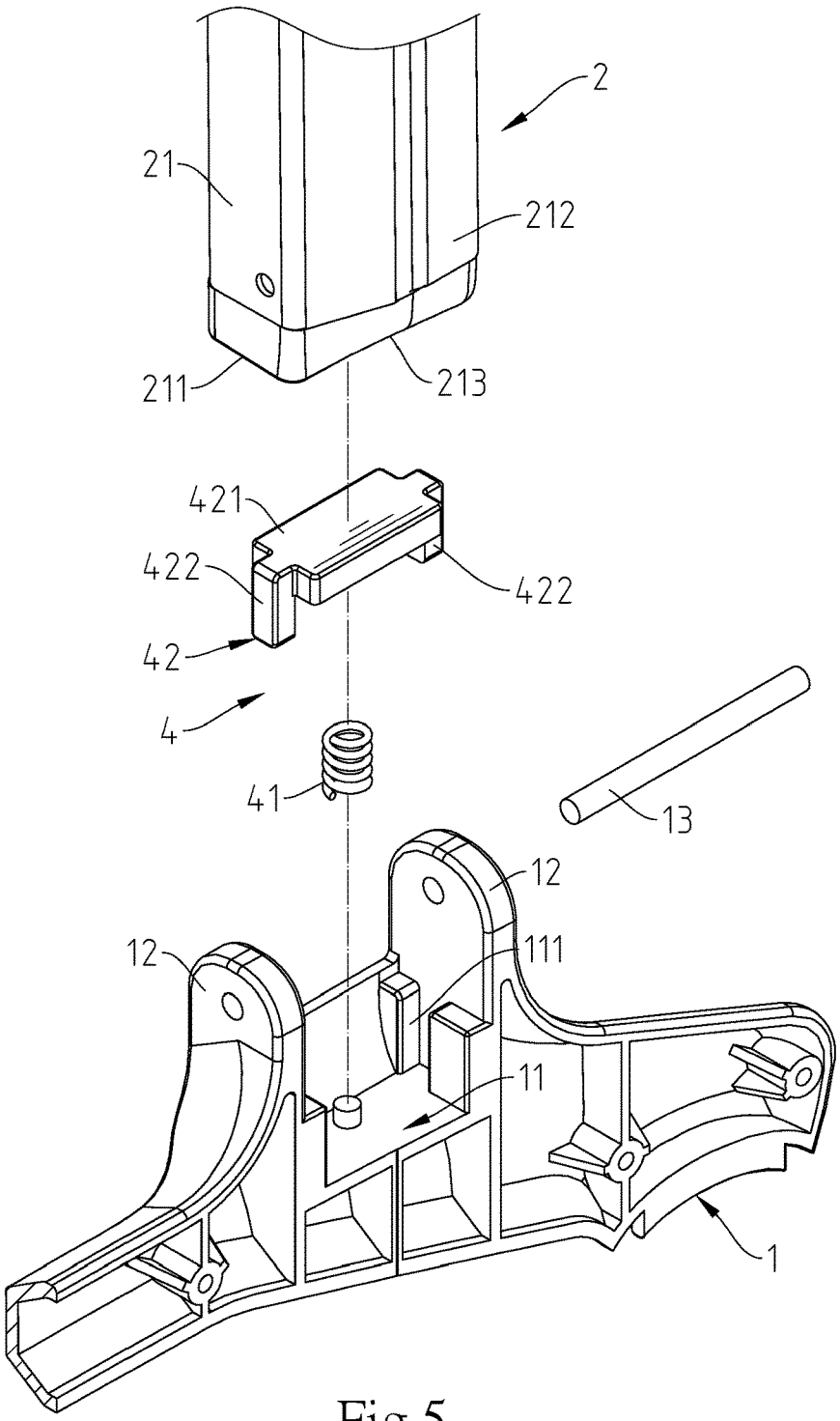
FIG. 5 is an exploded view of one base block, the respective pusher and the respective outer tube of the retractable handle assembly.

Referring to FIGS. 1-5 and FIG. 8, a folding collapsible luggage in accordance with the present invention is shown. The folding collapsible luggage comprises two base blocks 1, a retractable handle assembly 2, a luggage body 3 and two pushers 4.

The base blocks 1 each comprise an accommodation chamber 11 defined in a front side thereof, two sliding grooves 111 located in the accommodation chamber 11 at two opposite lateral sides, two pivot lugs 12 bilaterally disposed outside the accommodation chamber 11 in a parallel manner, a pivot axle 13 mounted between the two pivot lugs 12, and a plurality of rollers 14 pivotally mounted at an opposing rear side thereof.

The retractable handle assembly 2 comprises two outer tubes 21, two inner tubes 22 respectively slidably coupled to and movable in and out of the outer tubes 21, two hook members 23 respectively fastened to the inner tubes 22, and a grip 24 coupled to and movable in and out of the inner tubes 22. Each hook member 23 comprises a mounting collar 231 attached onto one respective inner tube 22, a hook portion 232 extended from one side of the mounting collar 231, and a locating hole 233 cut through the peripheral wall of the mounting collar 231. Each inner tube 22 comprises a spring loaded locking pin 221 releasably locked in the locating hole 233 of the respective hook member 23. Each outer tube 21 has one end, namely, the bottom end thereof pivotally connected to the pivot axle 13 of one respective base block 1, defining on the bottom end a first abutment surface 211, a second abutment surface 212 and a smoothly curved guide surface 213 between the first abutment surface 211 and the second abutment surface 212.

The luggage body 3 comprises a bottom panel 31, a back panel 32 perpendicularly and upwardly extended from a rear side of the bottom panel 31, a folding panel 33 vertically upwardly extended from a top side of the back panel 32 opposite to the bottom panel 31, two hanging lugs 34 mounted at the folding panel 33 for the hooking of the hook portions 232 of the respective hook members 23, a peripheral panel 35 perpendicularly and forwardly extended from the border edge of the back panel 32 and the border edge of the folding panel 33, a front cover panel 36 perpendicularly and upwardly extended from an opposing front side of the bottom panel 31 opposite to the back panel 32, a zip fastener 37 fastened to the border edge of the front cover panel 36 and the border edge of the peripheral panel 35 and operable to open or close the front cover panel 36. Further, the bottom panel 31 is affixed to the base blocks 1. The back panel 32 is affixed to the outer tubes 21 of the retractable handle assembly 2.

The pushers 4 each comprise a spring member 41 and a pushing block 42. The spring member 41 and pushing block 42 of each pusher 4 are accommodated in the accommodation chamber 11 of one respective base block 1. The pushing block 42 comprises a planar pushing wall 421, and two guide rails 422 respectively perpendicularly extended from two opposite lateral sides of the planar pushing wall 421 and respectively slidably coupled to the sliding grooves 111 of the respective base block 1. The spring member 41 has two opposite ends thereof respectively abutted against the planar pushing wall 421 of the pushing block 42 and a bottom surface of the accommodation chamber 11 of the respective base block 1.

Thus, since the outer tubes 21 of the retractable handle assembly 2 and the back panel 32 of the luggage body 3 are fixedly fastened together and the folding panel 33 of the luggage body 3 is connected to the hook portions 232 of the hook members 23 of the retractable handle assembly 2 through the hanging lugs 34, the back panel 32 and folding panel 33 of the luggage body 3 are well supported in shape after the luggage body 3 is extended out for application, and thus, no further structural reinforcement will be necessary for the luggage body 3.

Figure 6:
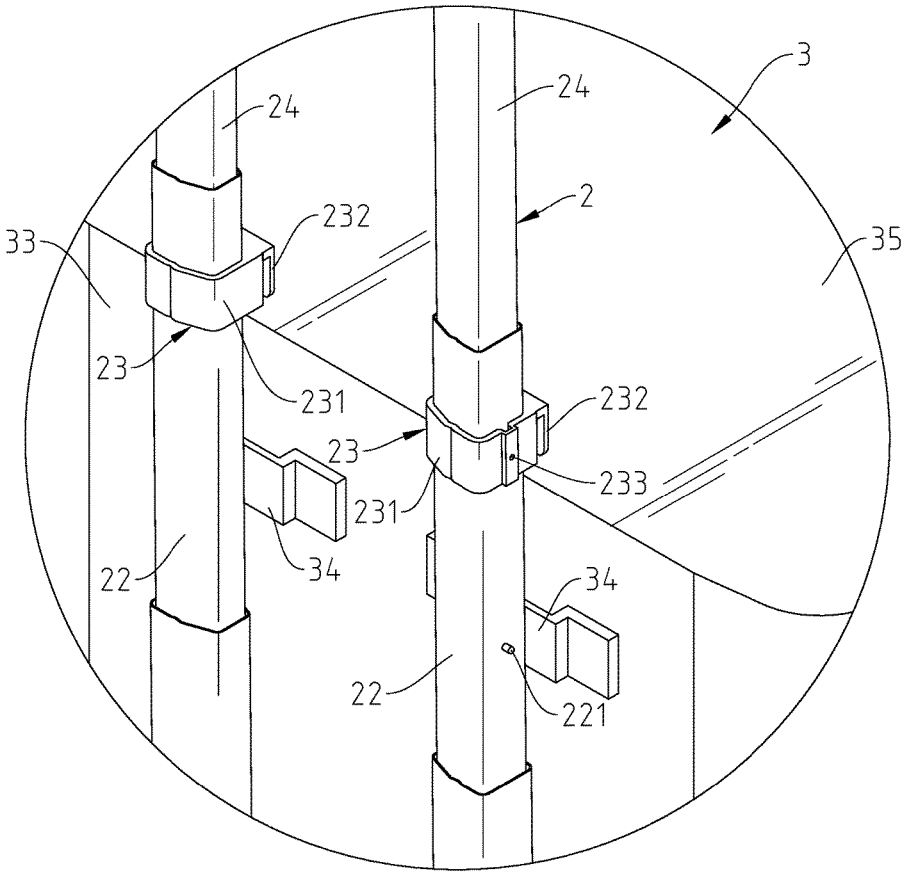
FIG. 6 is an enlarged view of a part of the present invention, illustrating the hook members disengaged from the respective hanging lugs.
Figure 7:
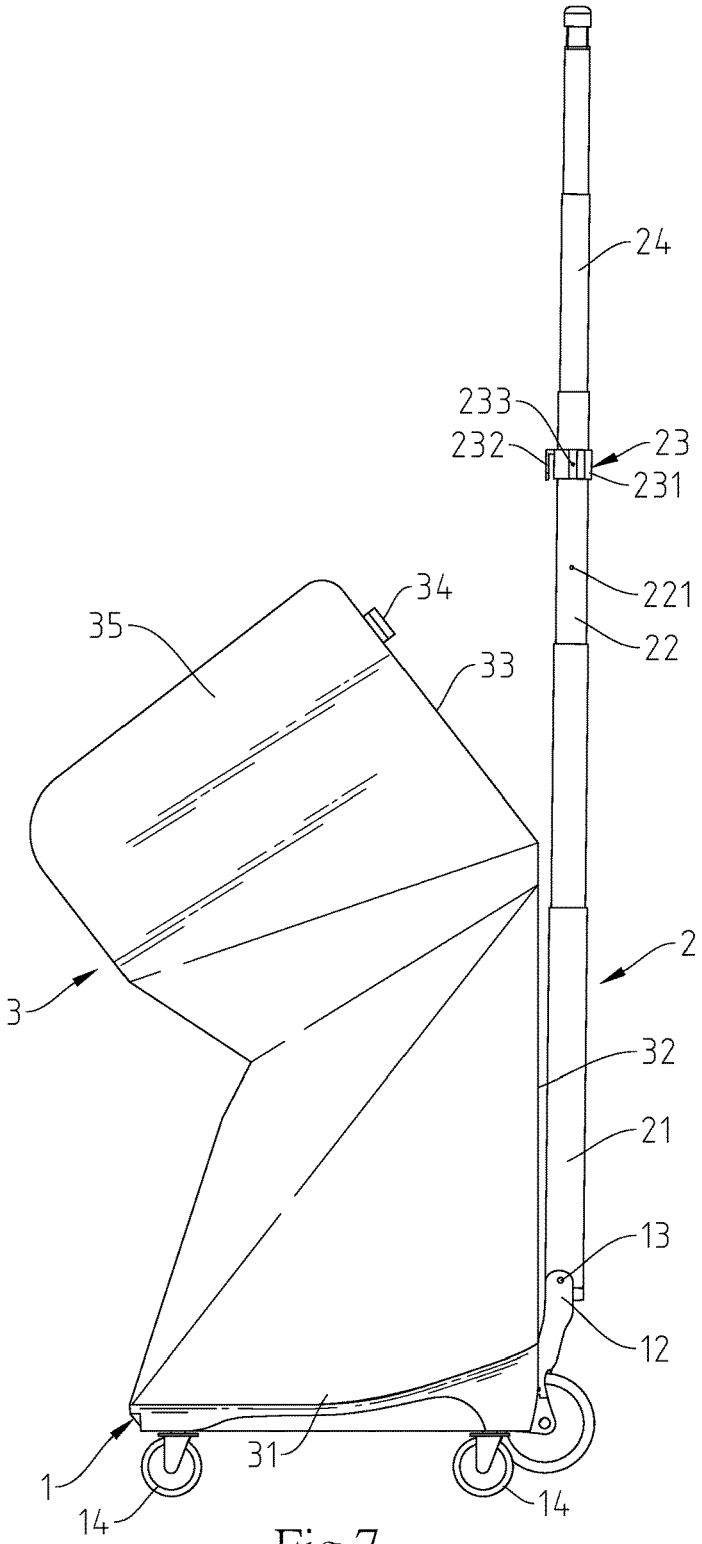
FIG. 7 is a schematic side view of the present invention, illustrating the folding panel of the luggage body disconnected from the retractable handle assembly and biased toward the collapsed position.
Figure 8:
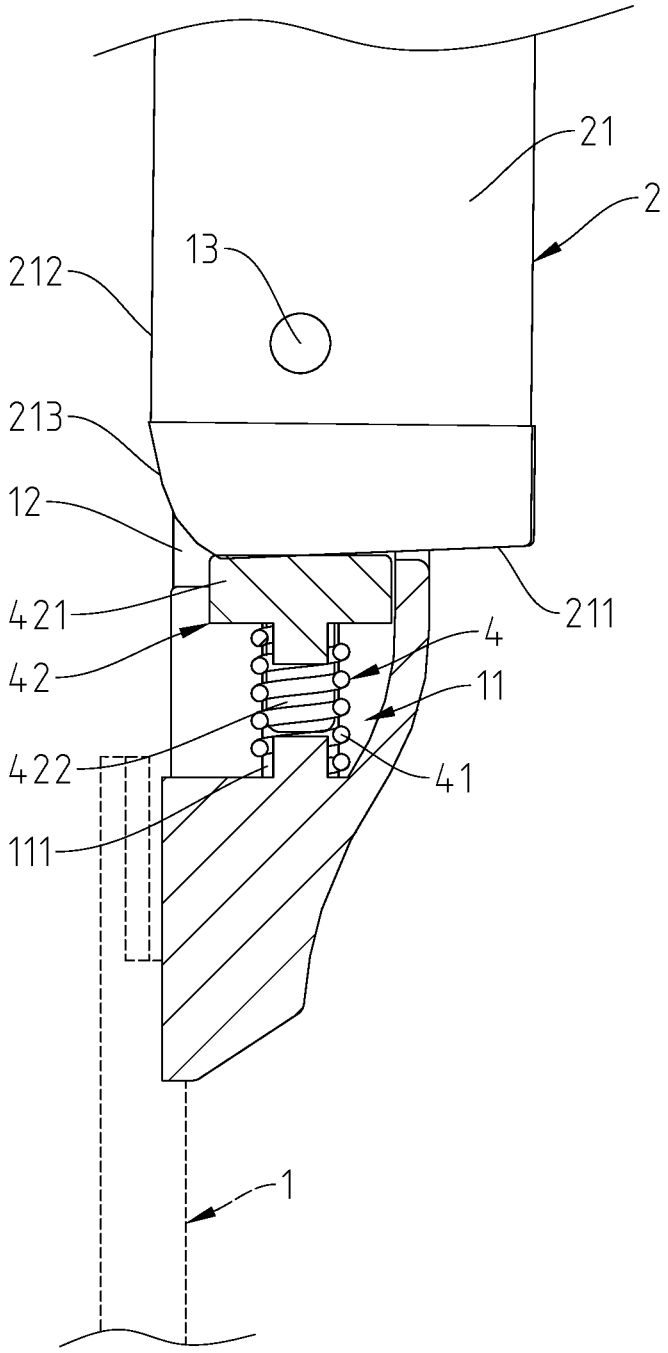
FIG. 8 is a schematic sectional view of a part of the present invention, illustrating the pusher abutted against the first abutment surface of the respective outer tube.
Figure 9:
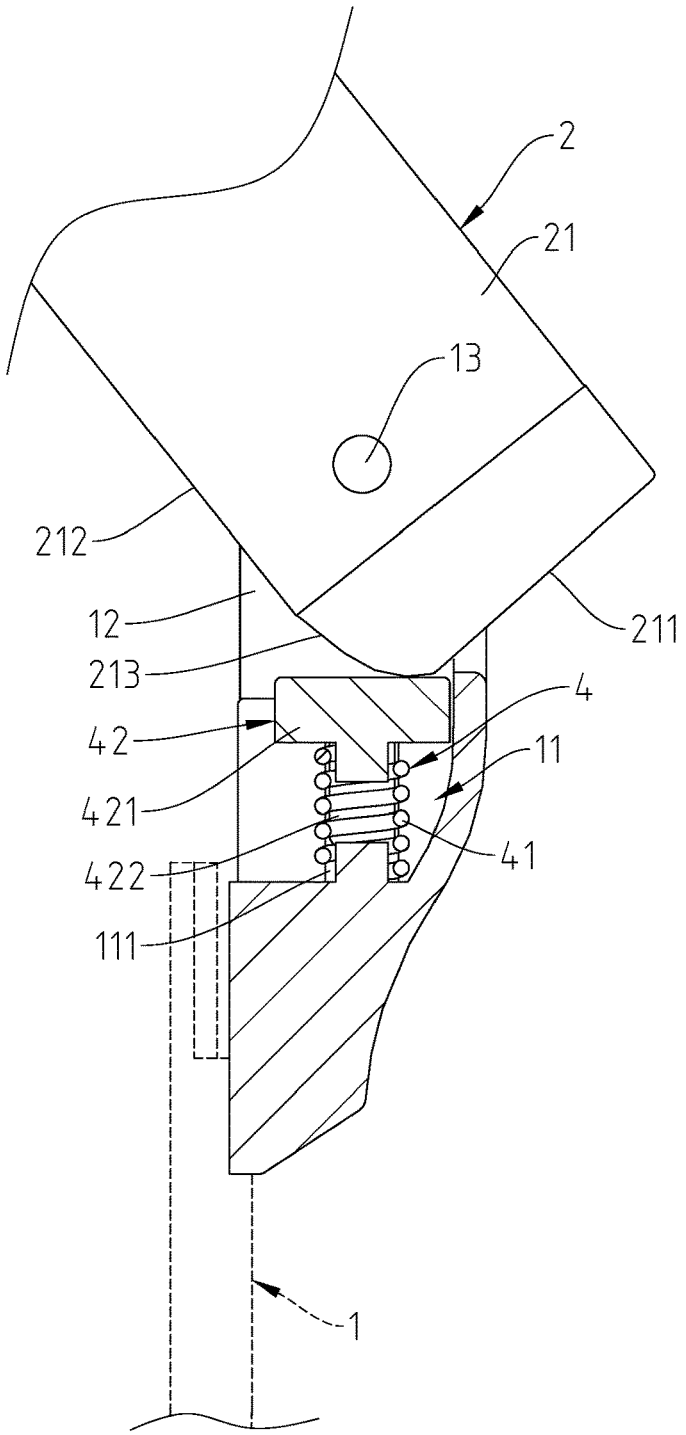
FIG. 9 corresponds to FIG. 8, illustrating the retractable handle assembly biased toward the collapsed position.
Figure 10:
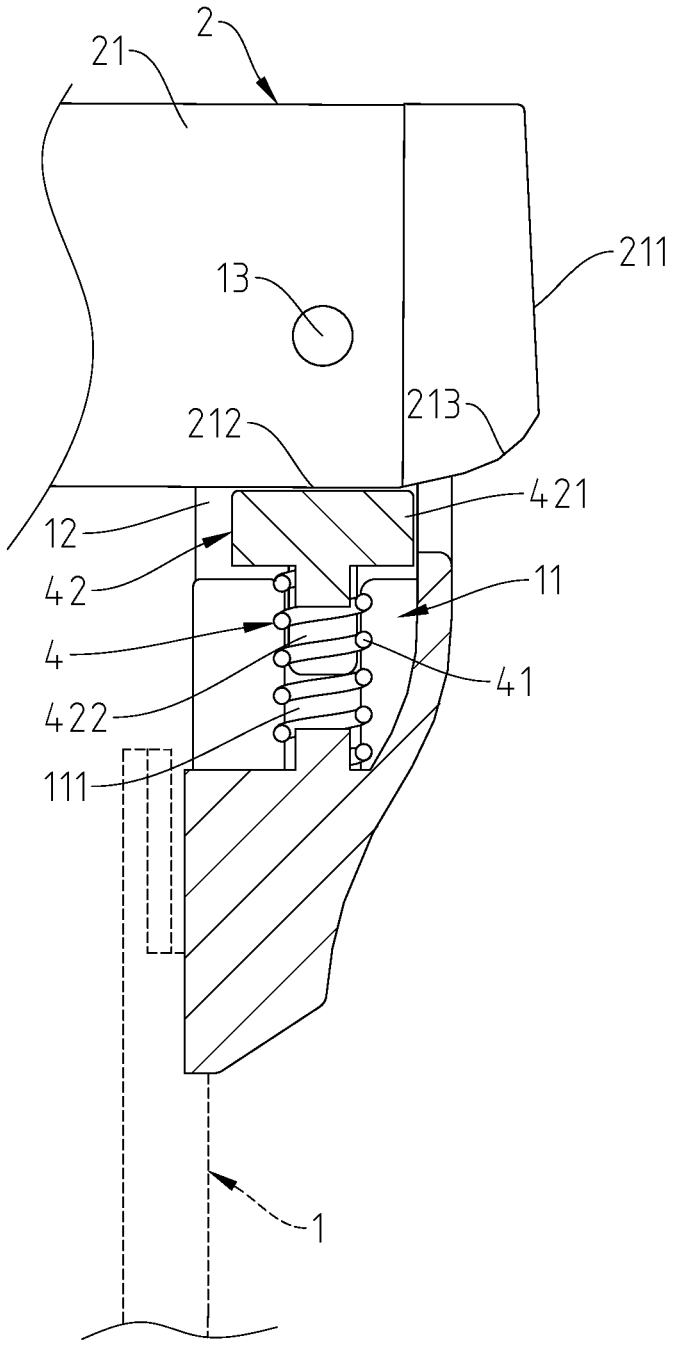
FIG. 10 is a schematic sectional view of a part of the present invention, illustrating the pusher abutted against the second abutment surface of the respective outer tube.
Figure 11:
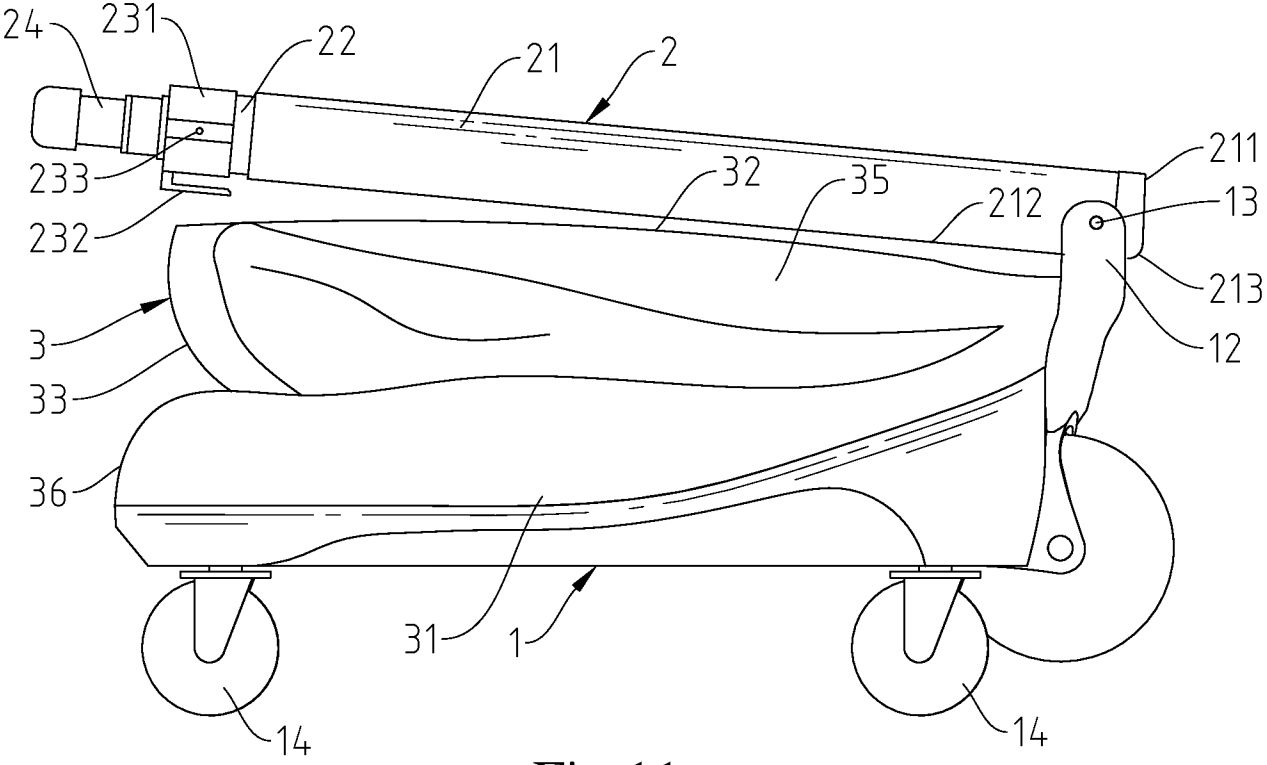
FIG. 11 is a schematic side view of the present invention, illustrating the folding collapsible luggage in the collapsed position.

Referring to FIGS. 6-11, when the user is going to collapse the luggage body 3 for storage, as illustrated in FIGS. 6 and 7, disengage the hook members 23 from the respective spring loaded locking pins 221 by removing the hook portions 232 of the hook members 23 from the respective hanging lugs 34, and then fold up the folding panel 33 of the luggage body 3 onto the back panel 32. After folded up the folding panel 33 onto the back panel 32, as illustrated in FIGS. 8-11, bias the outer tubes 21 toward the base blocks 1. At this time, the first abutment surfaces 211 of the outer tubes 21 are forced to push the respective pushing blocks 42 toward the bottom surfaces of the accommodation chambers 11 of the respective base blocks. Due to the design of the smoothly curved guide surface 213, the outer tubes 21 can be biased smoothly. When the second abutment surfaces 212 of the outer tubes 21 approaching the respective pushing blocks 42 in the biasing operation of the outer tubes 21, the pushing blocks 42 are forced upwards by the respective spring member 41 to accelerate the biasing operation of the outer tubes 21. As soon as the planar pushing walls 421 of the pushing blocks 42 are stopped against the second abutment surfaces 212 of the respective outer tubes 21, the luggage body 3 is collapsed. Since the pushing blocks 42 keep the outer tubes 21 in the collapsed position at this time, the collapsed luggage body 3 is held between the base blocks 1 and outer tubes 21 positively without the use of any other locking means. On the contrary, when going to extend out the luggage body 3 for application, bias the outer tubes 21 in the direction away from the base blocks 1, enabling the planar pushing walls 421 of the pushing blocks 42 to be moved toward the first abutment surfaces 211 of the respective outer tubes 21. At this time, the pushing blocks 42 are forced upwards by the respective spring member 41 to accelerate the biasing operation of the outer tubes 21. As soon as the planar pushing walls 421 of the pushing blocks 42 are abutted against the first abutment surfaces 211 of the respective outer tubes 21, the luggage body 3 is fully extended out. As this time, the user can hook the hook portions 232 of the hook members 23 on the respective hanging lugs 34.

What the invention claimed is:

1. A folding collapsible luggage, comprising:

a folding collapsible luggage body selectively set between a collapsed position and an extended position;

at least one base block fixedly mounted at a bottom side of said folding collapsible luggage body;

a retractable handle assembly comprising at least one outer tube fastened to a back side of said folding collapsible luggage body, each said outer tube having a bottom end thereof pivotally connected to one respective said base block and defining on the bottom end thereof a first abutment surface and a second abutment surface; and at least one pusher mounted in said at least one base block, each said pusher comprising a planar pushing block disposed at a bottom side relative to one respective said outer tube of said retractable handle assembly and a spring member stopped between said pushing block and one respective said base block to force said pushing block into abutment against the bottom end of the respective said outer tube;

wherein when biasing said folding collapsible luggage body from said extended position to said collapsed position, said at least one outer tube is biased toward said at least one base block, causing said pushing block of each said pusher to be forced by the respective said spring member into abutment against the said second abutment surface of the respective said outer tube; when biasing said folding collapsible luggage body from said collapsed position to said extended position, said at least one outer tube is biased in direction away from said at least one base block, causing said pushing block of each said pusher to be forced by the respective said spring member into abutment against the said first abutment surface of the respective said outer tube.

2. The folding collapsible luggage as claimed in claim 1, wherein each said base block comprises an accommodation chamber, two pivot lugs bilaterally disposed outside said accommodation chamber in a parallel manner, and a pivot axle mounted between said two pivot lugs; each said outer tube of said retractable handle assembly is pivotally connected to the said pivot axle of the respective said base block; the said spring member and said pushing block of each said pusher are accommodated in the said accommodation chamber of the respective said base block.

3. The folding collapsible luggage as claimed in claim 2, wherein each said base block further comprises two sliding grooves disposed in the said accommodation chamber thereof at two opposite lateral sides in a parallel manner; the said pushing block of each said pusher comprises a planar pushing wall, and two guide rails respectively extended from two opposite lateral sides of said planar pushing wall and respectively slidably coupled to the said sliding grooves of the respective said base block.

4. The folding collapsible luggage as claimed in claim 1, wherein said luggage body comprises a bottom panel located at the bottom side thereof and affixed to said at least one base block, a back panel perpendicularly upwardly extended from a rear side of said bottom panel and fixedly fastened to said at least one outer tube of said retractable handle assembly, a folding panel upwardly extended from a top side of said back panel remote from said bottom panel, and at least one hanging lug affixed to said folding panel; said retractable handle assembly further comprises at least one inner tube coupled to and movable in and out of said at least one outer tube, and a hook member fastened to each said inner tube for hooking on one respective said hanging lug.

5. The folding collapsible luggage as claimed in claim 4, wherein said hook member comprises a mounting collar fastened to one respective said inner tube of said retractable handle assembly, a hook portion extended from said mounting collar for hooking on one respective said hanging lug, a locating hole located on said mounting collar; each said inner tube of said retractable handle assembly comprises a spring loaded locking pin releasably engaged into the said locating hole of one respective said hook member.

6. The folding collapsible luggage as claimed in claim 1, wherein each said outer tube of said retractable handle assembly further defines a smoothly curved guide surface between said first abutment surface and said second abutment surface.

* * * * *